US006782231B2

(12) United States Patent
Fuma et al.

(10) Patent No.: US 6,782,231 B2
(45) Date of Patent: Aug. 24, 2004

(54) PRESSURE APPLYING DEVICE TO FIXING ROLLER OF IMAGE FORMING APPARATUS

(75) Inventors: Hiroshi Fuma, Hachioji (JP); Hisayoshi Nagase, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/146,365

(22) Filed: May 15, 2002

(65) Prior Publication Data

US 2002/0176724 A1 Nov. 28, 2002

(30) Foreign Application Priority Data

May 25, 2001 (JP) ..... 2001-156870

(51) Int. Cl.[7] ..... G03G 15/20
(52) U.S. Cl. ..... 399/328; 219/216; 399/329
(58) Field of Search ..... 399/328, 329, 399/331, 332; 219/216; 432/59, 60

(56) References Cited

U.S. PATENT DOCUMENTS 6,366,745 B1 * 4/2002 Adachi et al. ..... 399/328

FOREIGN PATENT DOCUMENTS

JP 6-316349 A * 11/1994
JP 7-92847 A * 4/1995

* cited by examiner

*Primary Examiner*—Joan Pendegrass
(74) *Attorney, Agent, or Firm*—Muserlian, Lucas and Mercanti

(57) ABSTRACT

The fixing device having therein the heating member for heating a toner image, the pressure applying member arranged to face the heating member for performing a pressure contact to the heating member, an urging means which urges the pressure applying means, and a changeover means which changes the condition of the pressure applying member from the pressure contact condition to the heating member to the pressure contact released condition by controlling the urging means, wherein urging power by the urging means under the pressure contact released condition is lower than that under the pressure contact condition.

13 Claims, 7 Drawing Sheets

PRESSURE APPLYING DEVICE TO FIXING ROLLER OF IMAGE FORMING APPARATUS

BACKGROUND OF THE INVENTION

The present invention relates to an image forming apparatus which forms an image by an electrophotographic method, and more particularly to an improvement of a fixing device of the image forming apparatus.

(1) A technology for energy saving is one of the subjects of development in the technical field relating to the image forming apparatus which forms an image on a recording material by the electrophotographic method. The power consumption of the electrophotographic image forming apparatus depends upon the power consumption of the fixing device so largely that the energy saving in the fixing device represents the saving of power consumption in the image forming apparatus, and accordingly, the development of the technology for suppressing the energy consumption in the fixing device is the aforementioned subject of development.

Concerning the electric power which is consumed in the fixing device, the energy consumption under a stand-by condition is overwhelmingly greater than the energy consumption under an image forming condition. Accordingly, there is paid much attention for suppressing the energy consumption of the fixing device in the stand-by condition, that is, there is paid much attention to the development of the fixing device, which is kept under the condition that the power supply is not given to a heat source of the fixing device, or the condition that lower electric power is given even if power is given, and which can rise to the condition being capable of fixing within a short time, when a starting button of an image formation is operated, or when an instruction for an image formation is given from the outside.

A belt having small heat capacity is influential for a heating member of the fixing device having a short rise time mentioned above, and hitherto, there have been a great number of patent applications concerning the fixing device in which the belt is used for the heating member.

Further, it is performed that temperature of the heating member is raised to the temperature capable of fixing, while the heating member is released from a pressure applying member. Since the aforementioned rise-up of the heating member prevents heat of the heating member from traveling to the pressure applying member, the heat capacity of a heat receiving system becomes so small that the heating member can rise to be the temperature level capable of fixing within a short time.

(2) Generally, the fixing device is provided with the heating member and the pressure applying member. The fixing device fixes the toner image on the recording member by heat and pressure, by making both of the heating member and the pressure applying member to come into contact with each other by the prescribed pressure, and making a recording member having an unfixed toner image to pass between the heating member and the pressure applying member.

In the conventional fixing device, the pressure applying member is provided under the condition where the pressure applying member is brought into contact with the unmovable heating member, or is released from the unmovable heating member, and the pressure applying member is pressed to the heating member by the movement from the released position that is not under the acting condition, when the image formation is performed. Further, when releasing the pressure applying member from the heating member, the pressure applying member has been moved against urging of an urging means.

(1) It has become clear that if there is a difference between the surface speed of the heating member and that of the pressure applying member, when the pressure applying member is brought into contact with the heating member, the difference causes stress which gives undesirable influence upon these members. That is, it has become clear that the surface of the heating member or the pressure applying member changes in formation or changes in quality. Especially, when one having a rubber surface with lower hardness on the surface or a belt is used as the heating member, these changing are clear, and off-set occurs or the belt is broken in an extreme case.

The object of the present invention is to solve the above-mentioned problem of the fixing device wherein the pressure applying member is kept to be released from the heating member during the stand-by condition, and the pressure applying member comes in contact with the heating member when the image is formed, and further, to provide a fixing device of an energy saving type which can keep good fixing performance for a long time, still further, to provide an image forming apparatus having therein the above-mentioned fixing device.

(2) Under the construction that the pressure applying member is brought into pressure contact with the heating member by the urging means, the pressure applying member is brought into contact with the heating member by the prescribed pressure when pressure is applied. Therefore, it is necessary to apply releasing power which is stronger than pressuring power on the pressure applying member, when the pressure applying member is released from the heating member, which means that great power is necessary for releasing the pressure contact. A motor is used generally as a driving means which performs pressure contact/releasing of pressure contact of the pressure applying member, however, the motor having large power is necessary, resulting in problems that the electric power consumption is large and the cost is high.

Another object of the invention is to solve the above-mentioned problems of a mechanism which performs pressure contact/releasing of the pressure applying member onto the heating member, and to provide a fixing device of a type of low energy consumption and low cost, and to provide an image forming apparatus having therein the above-mentioned fixing device.

SUMMARY OF THE INVENTION

The objects of the invention will be attained by either one of the Structures shown below.

Structure (1) The fixing device in which a pressure applying member is provided to be in contact with or away from a heating member which heats a toner image, and fixing is conducted by making the recording material carrying thereon a toner image to pass between the heating member and the pressure applying member, under the condition that the pressure applying member is brought into pressure contact with the heating member, wherein there are provided a changeover means which switches a condition of the heating member and the pressure applying member between a pressure contact condition and a pressure contact released condition, and a driving means which drives the heating member and the pressure applying member under the pressure released condition, and when the changeover means changes the condition from the pressure released condition to the pressure contact condition, the changeover means conducts switching so that either one of the heating member and the pressure applying member may be separated from the driving means, and may touch the other party being driven by the driving means under the condition that either one of the heating member and the pressure applying member released from the driving means is moved by inertial force.

Structure (2) The fixing device mentioned in the Structure (1), wherein there is provided the driving means which transports the recording material by driving the heating member.

Structure (3) The fixing device mentioned in the Structure (1), wherein the changeover means forms the pressure contact condition and the pressure released condition, by changing the position of the pressure applying member.

Structure (4) The fixing device mentioned in either one of the Structures (1) to (3), wherein the changeover means uncouples the pressure applying member from the driving member.

Structure (5) The fixing device mentioned in either one of the Structures (1) to (4), wherein the heating member is represented by a heating belt, and the fixing is performed by making the heating belt to touch the recording material.

Structure (6) The fixing device mentioned in the Structure (5), wherein there is provided a heating means which heats the heating member.

Structure (7) The fixing device mentioned in the Structure (6), wherein the heating means has a heat source and a heating roller which is heated by the heat source, and about which the heating belt is trained.

Structure (8) The fixing device mentioned in either one of the Structures (5) to (7), wherein the heating belt is provided with a base body and a heat-resistant elastic layer formed on the base body.

Structure (9) The fixing device mentioned in either one of the Structures (1) to (4), wherein each of the heating member and pressure applying member is composed of roller.

Structure (10) The fixing device in which a pressure applying member is provided to be in contact with or away from a heating member which has a toner image, and fixing is conducted by making the recording material carrying thereon a toner image to pass between the heating member and the pressure applying member, under the condition that the pressure applying member is brought into pressure contact with the heating member, wherein, there is provided a driving means which drives the heating member and pressure applying member under the condition that the pressure applying member is released from the heating member, and the driving means drives either one of the heating member and the pressure applying member through a torque limiter.

Structure (11) The fixing device mentioned in the Structure (10), wherein the torque limiter has transmission torque Q having the range shown by the following formula:

$$19.6\times10^{-4}<Q<9.8\times10^{-3}(N\cdot m).$$

Structure (12) The fixing device mentioned in the Structure (10) or (11), wherein the heating member is composed of a heating roller.

Structure (13) The fixing device mentioned in the Structure (10) or (11), wherein the heating member is composed of the heating belt.

Structure (14) The fixing device having therein the heating member for heating a toner image, the pressure applying member arranged to face the heating member, an urging means which urges the pressure applying means, and a changeover means which changes the condition of the pressure applying member from the pressure contact condition to the heating member to the pressure contact released condition by controlling the urging means, wherein urging power by the urging means under the pressure contact released condition is lower than that under the pressure contact condition.

Structure (15) The fixing device mentioned in the Structure (14), wherein the urging means forms a non-urging condition under the pressure released condition.

Structure (16) The fixing device mentioned in the Structure (14), wherein the urging means forms an urging condition under the pressure released condition.

Structure (17) An image forming apparatus wherein there are provided an image forming means which forms an unfixed toner image on the recording material, and the fixing device mentioned in either one of the Structures (1) to (16).

DETAILED DESCRIPTION OF THE PREFERRED EMBODIMENT

Figure 1:
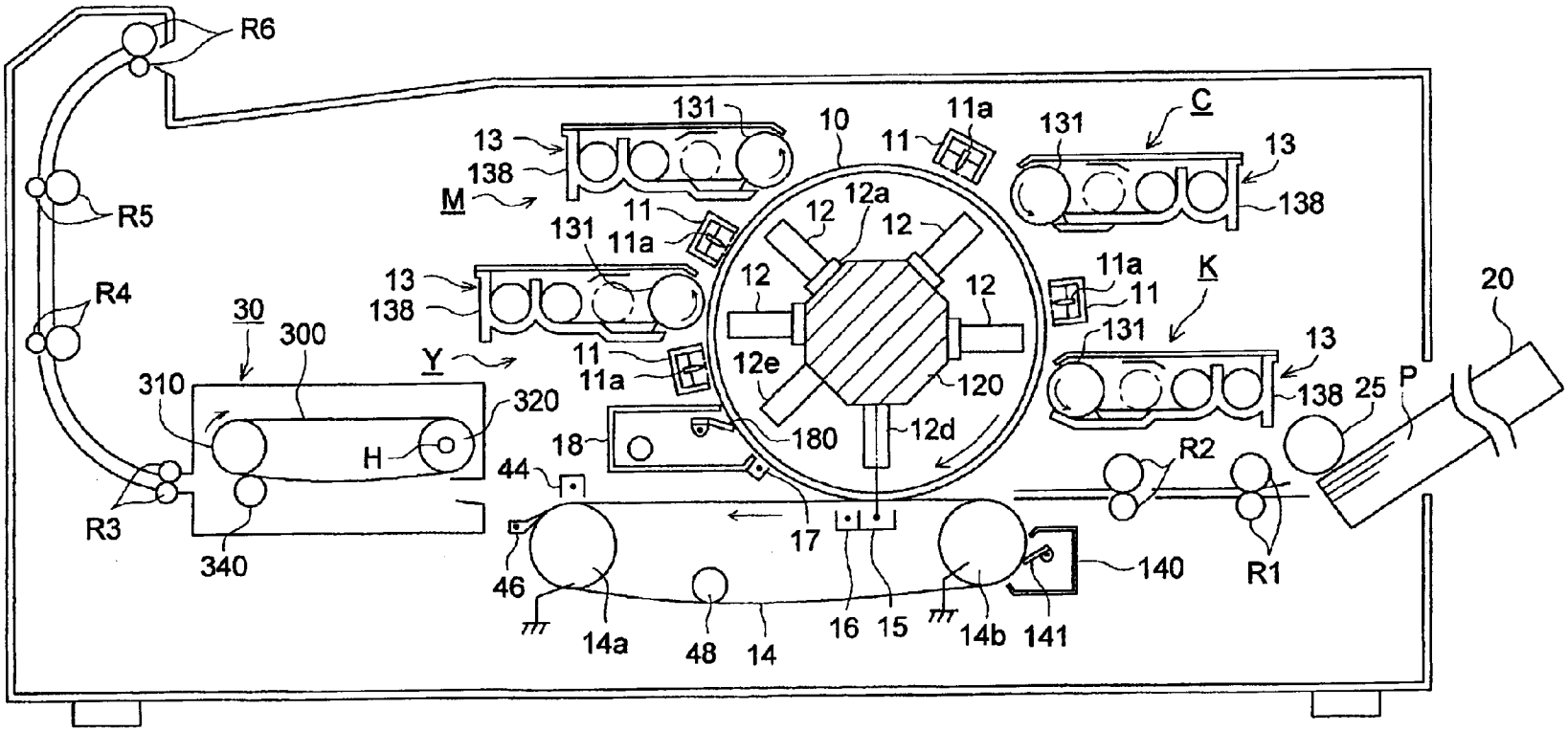
FIG. 1 is a whole structural drawing of a color printer of the embodiment of the invention.

The embodiments of the invention will be described in details as bellow, referring to the drawings.

FIG. 1 is a drawing showing the whole construction of a color printer of the embodiment of the invention.

In FIG. 1, numeral 10 is a photoreceptor drum (hereinafter referred to as a drum) representing an image forming body, numeral 11 is a scorotron charger representing a charging means for each color, numeral 12 is an exposure-optical system representing an image writing means for each color, numeral 13 is a developing device representing a developing means for each color, and numeral 14 is a transfer belt.

The drum 10 is one wherein a transparent conductive layer and a photoreceptive layer such as a-Si layer or an organic photoreceptive layer (OPC) are formed on an outer circumferential surface of a cylindrical base body made of a transparent member such as, for example, an optical glass or a transparent acryl resin, and it is rotated in the clockwise direction indicated by an arrow in FIG. 1, with the conductive layer being grounded.

The scorotron charger 11, the exposure-optical system 12 and the developing device 13 make one set, and there are provided four sets each being a mono-color image forming means which forms a mono-color image for each of yellow (Y), magenta (M), cyan (C) and black (K), and they are arranged in the order of Y, M, C and K in the rotating direction of the drum 10. Thus, the image forming means which forms a full color image on recording member P is constructed by the drum 10, four sets each being a mono-color image forming means and transfer device 15.

Since the mechanical constructions of the four sets each being the mono-color image forming means are the same basically, the construction of one set will be explained in detail to represent all of the four sets.

The scorotron charger 11 is provided with a control grid being held at the prescribed potential respectively, and for example, with discharging electrode 11*a* representing a saw-tooth type electrode, and is mounted to face the photoreceptive layer of the drum 10, and gives an even potential on the surface of the drum 10 by corona discharge having the same polarity with toner.

The exposure-optical system 12 is arranged in the drum 10 so that the exposure-optical system 12 may be positioned at the downstream side of the scorotron charger 11 in the rotating direction of drum 10.

The exposure-optical system 12 is an exposure unit composed of linear exposure element 12*a* wherein a plurality of LEDs (light emitting diode) each representing light emitting element for image-exposure light are lined up in an array parallel to the drum shaft in the direction of main scanning, a light convergent type light transmission body (brand name: SELFOC Lens Array) representing an image forming element, and an unillustrated lens holder, and the exposure-optical system 12 is attached to holding member 120.

Other than the exposure-optical system 12 for each color, simultaneously exposing transfer device 12*d* and uniform exposure device 12*e* which are the same construction are attached on the holding member 120, and they are installed in the base body of the drum 10 integrally.

The exposure-optical system 12 exposes the photosensitive layer of the drum 10 to an image from the back side, according to the image data read by an image reading device on the other body and stored in the memory, and forms an electrostatic latent image on the drum 10.

Though normally used is an emission wavelength of the exposure element being in the range of 780 nm to 900 nm, which has high transmittance to toner of Y, M and C, the wavelength of 400 nm to 780 nm can also be used in the present embodiment and the greater transmittance to color toner is not necessary, because the image exposure is performed from the back side.

The developing device 13 is provided with developing sleeve 131 formed by a cylindrical non-magnetic stainless steel or aluminum material which keeps the prescribed clearance to the peripheral surface of the drum 10 and rotates in the same rotating direction of the drum 10 at the close point, and development casing 138 in which the single component developers or two components developers for yellow (Y), magenta (M), cyan (C) and black (K) respectively are stored.

The developing device 13 is kept to be non-contact with the drum 10 with the prescribed clearance from the drum 10, and performs the non-contact reversal development, when the developing bias representing the alternating current voltage superimposed on the direct current voltage is applied on the developing sleeve 131, and forms the toner image on the drum 10.

Symbols 14*a* and 14*b* are rollers about which the transfer belt 14 is trained tightly, and the symbol 14*a* receives driving power from an unillustrated driving source, to rotate the transfer belt 14 in the direction indicated by an arrow.

The numerals 15 and 16 are respectively a transfer device and a neutralizing device which are arranged to face the drum 10 with the transfer belt 14 between, the numeral 17 is an AC neutralizing device to neutralize the drum 10 which has passed through the transfer area, and the numeral 18 is a cleaning device to clean the surface of the drum after the neutralizing of electricity, and has cleaning blade 180.

Numeral 20 is a cassette to store the recording material P on which the toner image formed on the drum 10 is transferred, and numeral 25 is a sheet feeding roller.

Along the feeding path for the recording material P, there are provided paired conveyance rollers R1 to R6, the transfer belt 14, and fixing device 30 including heating belt 300 which is driven at the same linear speed as the moving speed of the recording material P.

Numeral 44 shows the AC neutralizing device for separating the sheet, being arranged to face the roller 14*a* through the transfer belt 14.

Numeral 46 is a separation claw which has a function to separate the image transferred recording material P from the transfer belt sent integrally with the transfer belt 14 securely, and is positioned with its tip close to the surface of the transfer belt 14 on the roller 14*a*.

The following is the process of the image formation in the image forming apparatus having the above-mentioned construction.

After the fixing device 30 enters the fixing capable condition (that is, warm-up is completed), the drum 10 is started by an unillustrated drum driving motor by an operation of an unillstrated image formation starting key or an image formation order from the outside, and the drum 10 rotates in the clockwise direction shown by an arrow in FIG. 1, and at the same time, scorotron charging device 11 for yellow (Y) operates to give the prescribed electric potential to the drum 10.

Then, an image writing is performed by an electric signal corresponding to a first color signal, that is Y image datum, through Y exposure optical system 12, and an electrostatic latent image corresponding to the Y image of the original image is formed on the surface of the drum 10.

The reversal development is performed for the electrostatic latent image by developing device 13 for Y under the non-contacting condition, and the Y toner image is formed on the drum 10.

Next, the drum 10 is given an electric potential on the Y toner image by the charging action of a magenta (M) scorotron charging device 11, the electrostatic latent image corresponding to M image is formed by the image writing by the electric signal corresponding to a second color signal, that is the M image data, via M exposure optical system 12, and magenta (M) toner image is formed to be superimposed on the yellow (Y) toner image, by the non-contact reversal development of the M developing device 13.

By the process mentioned above, cyan (C) toner image corresponding to a third color signal is formed to be superimposed by cyan (C) scorotron charging device 11, C exposure optical system 12 and C developing device 13, and further on it, black (K) toner image corresponding to a fourth color signal is formed to be superimposed successively by black (K) scorotron charging device 11, K exposure optical system 12 and K developing device 13, accordingly, there are formed four color toner images to be superimposed representing yellow (Y), magenta (M), cyan (C) and black (K), within a single rotation of the photosensitive drum 10.

The image writing on the photosensitive layer of the drum 10 by the exposure optical system 12 of Y, M, C and K is performed from the inside of the drum 10 by passing through the light transparent base body.

Accordingly, each of the image writing for the second, third and fourth color signals is performed, without being influenced by pre-formed toner image, thus, it is possible to form the electrostatic latent image which is the same in terms of grade as that for the first color signal.

The superimposed color toner images which are formed by the above-mentioned image forming process on the drum 10 representing the image forming body are transferred collectively on the recording material P which is conveyed in timing, by the action of the transfer device 15 in the transfer area.

In this case, to perform the better transfer, it is preferable that transferring exposure device 12*d* provided in the drum 10 exposes uniformly.

Toner remaining on the surface of the drum 10 after the transfer process is finished receives the neutralization action of the AC neutralization device 17, and is removed by the cleaning device 18, thus, the drum surface is ready for the next image formation. Further, the transfer belt 14 from which the recording material P is separated is cleaned by the cleaning device 140.

In the present embodiment, after the cleaning and before the next charging, uniform exposure device 12*e* employing a light emitting diode, for example, is operated to erase the history for the former image formation on the surface of the drum.

On the other hand, after the recording material P on which the color toner image is transferred is separated from drum 10 by the action of the neutralizing device 16, the recording material P is conveyed by the transfer belt 14, then, is separated from the transfer belt 14 by the neutralization action of the AC neutralizing device 44 and the separation claw 46, and is guided to the fixing device 30.

The recording sheet P which has been subjected to fixing processing is conveyed by the feeding rollers R3 to R6, and is ejected.

(The First embodiment)

Figure 2:
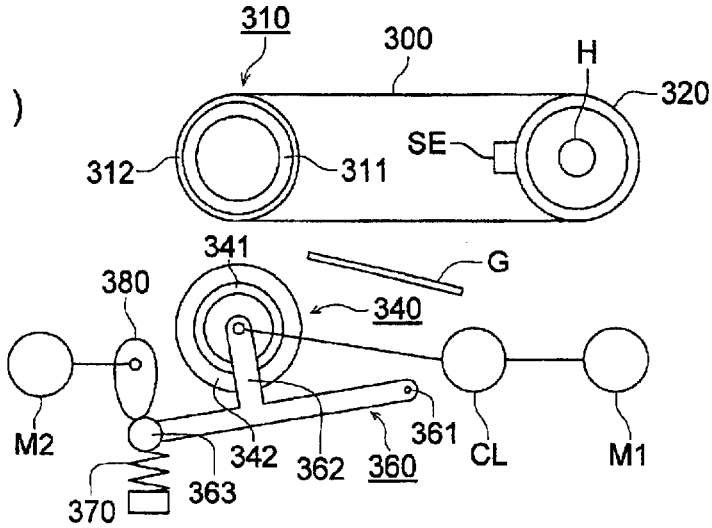
FIGS. 2(*a*)–2(*e*) are drawings showing the constructions of the fixing device of a first embodiment of the invention.
Figure 2:
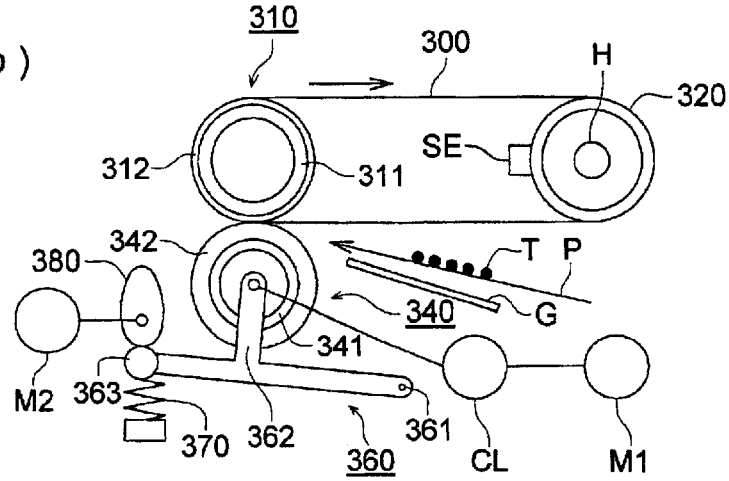
Figure 2:
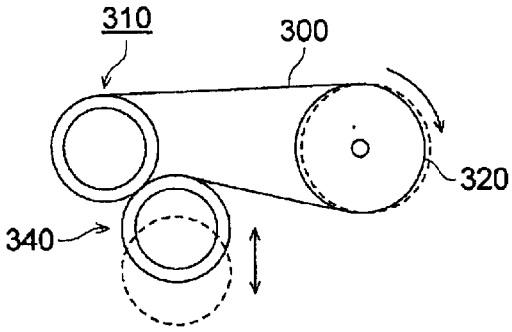
Figure 2:
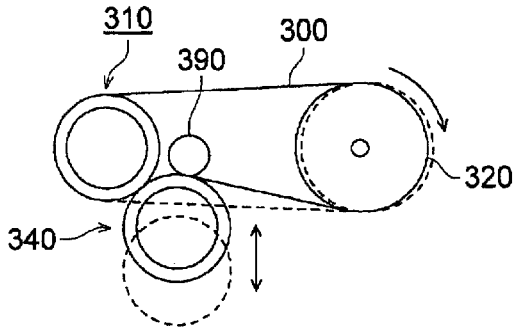
Figure 2:
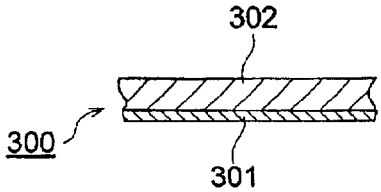

FIGS. 2(*a*)–2(*e*) are drawings showing the construction of the fixing device 30.

Numeral 300 is a heating belt representing a heating member which is composed of endless-belt-shaped base body 301 made of metal having the thickness of 30 to 70 $\mu$m, and is composed of heat-resistant elastic layer 302 such as a silicon rubber having the thickness of 70 to 200 $\mu$m as the surface layer touching the recording material P, as shown in FIG. 2(*e*). Numeral 310 is a supporting roller composed of cylindrical base body 311 made of metal, and of heat-resistant elastic layer 312 such as a silicon rubber. Symbol H is a heat source representing a halogen lamp. Symbol 340 is a pressure applying roller representing a pressure applying member composed of cylindrical base body 341 made of metal, and of heat-resistant elastic layer 342 such as a silicon rubber having the thickness of 1 to 5 mm. The heating roller 300 is trained about the supporting roller 310 and the heating roller 320 tightly, and is driven by the supporting roller 310 representing the drive roller to convey the recording material P by moving on a cyclic basis as shown by an arrow. The heating roller 320 is heated by heat generated by the heat source H, and the heating roller 320 heats up the heating belt 300 to the temperature by which unfixed toner image T on the recording material P can be fixed.

Temperature sensor SE detects the surface temperature of the heating roller 320, and control means CPU (shown in FIG. 3) controls the heat source H based on the output of the temperature sensor SE, to keep the heating belt 300 at the prescribed temperature. Symbol G is a guiding member to guide an approach of the recording material P.

Under the stand-by condition of the image forming apparatus, that is, under the stand-by condition of the fixing device, as shown in FIG. 2(*a*), pressure applying roller 340 is released from the heating roller 300 and the supporting roller 310. Further, under the stand-by condition, the heat source H is under the OFF condition, and the fixing device does not consume the electric power. Or, it is also possible to make a constitution that low level electric power is supplied to the heat source H, and the heating roller 32 is pre-heated by the low power consumption.

When the time of the stand-by condition is short, the temperature of the heating roller 320 is established relatively high. Accordingly, in the case of the short stand-by condition, the electric power supply to the heat source H is relatively large, and in the case of the long standby-condition, the temperature of the heating roller is established relatively low, and the electric power supply to the heat source H is relatively small. In the actual control, it is preferable that the timer is started when the warm-up is finished or the image formation is finished, and that the established temperature is lowered continuously or stepwise, based on the time counted by the timer.

The pressure applying roller 340 is supported rotatably on the supporting section 362 provided on support lever 360 supported rotatably on shaft 361, and the support lever 360 is urged by coil spring 370 representing an urging means. Roller 363 is provided at the end of the other end portion of the shaft 361 of the support lever 360, and the roller 363 is in contact with rotating cam 380. The rotating cam is driven by motor M2 to rotate.

When there is an operation of the copy button or an image formation order from the outside through the network, the electric power for the fixing is supplied to the heat source H, the support roller 310 and the heating roller 320 rotate to start moving the heating belt 300 on a cyclic basis simultaneously, and pressure applying roller 340 goes up to come in pressure contact with the heating belt as shown in FIG. 2(*b*) simultaneously. Under the condition as shown in FIG. 2(*b*), the pressure applying roller 340 is brought in contact with the heating belt 300 by the coil spring 370 with the prescribed pressure, then the fixing is performed by the action that the recording material P passes through between the heating belt 300 and the pressure applying roller 340.

The pressure applying roller 340 is connected to motor M1 that is a driving means through clutch CL. It is possible to make the motor M1 to serve concurrently as a motor as a driving means to convey and fix the recording material P, that is, as a motor to drive the support roller 310, or it is also possible to provide separately.

The motor M1 is turned on by an operation of the copy button or the image formation starting order from the outside to drive the pressure applying roller 340 to rotate. After driving the pressure applying roller 340 to rotate, the clutch CL is turned off to release the engagement between the motor M1 and the pressure applying roller 340, just before the pressure applying roller 340 touches the heating belt 300. Accordingly, when the pressure applying roller 340 touches the heating belt 300, the pressure applying roller 340 is rotating without being powered, that is, under the condition of inertia rotation.

In the structure where the pressure applying roller 340 which is not rotating touches the heating belt 300 which is rotating, the stress is caused when it touches. Even in the case where the pressure applying roller 340 which is connected to the motor M1 touches the heating belt 300, the stress is caused by the slight speed difference generated between the pressure applying roller 340 and the heating belt 300.

Due to the above-mentioned stress, the elastic layer 302 of the heating belt 300 and the elastic layer 342 of the pressure applying roller 340 are sometimes deformed, or their surfaces are sometimes scratched. Further, in the extreme case, the heating belt 300 is also broken.

The above-mentioned problems are solved by the manner that the pressure applying roller 340 is disengaged from the driving system to rotate freely by inertia, just before the touching, like the present embodiment.

Incidentally, it is desirable that the pressure applying roller 340 rotates at the circumferential speed nearly equal to the moving speed of the heating belt 300, and it is preferable that the operating timing of the clutch CL is established so that the pressure applying roller 340 touches the heating belt 300, while the pressure applying roller 340 is rotated by inertia at the circumferential speed which is nearly the same as the moving speed of the heating belt 300. Further, it is desirable that inertia is made to be small when the pressure applying roller 340 is rotated by inertia, and it is desirable that the clutch CL is provided at the section which is near the pressure applying roller 340 of the drive-transfer system.

Figure 3:
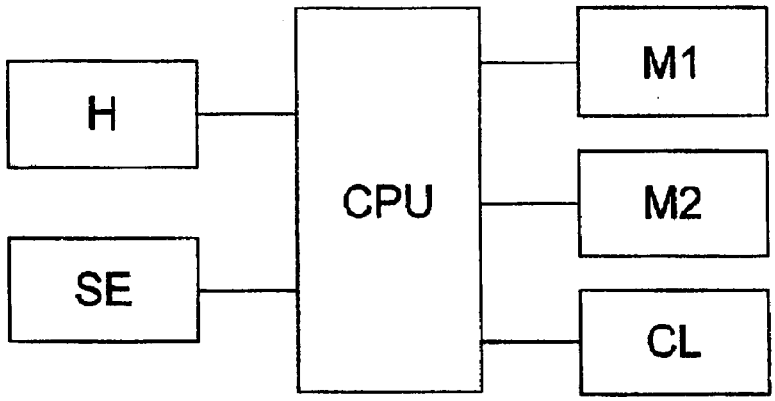
FIG. 3 is a block diagram of a control system of the first embodiment of the invention.
Figure 4:
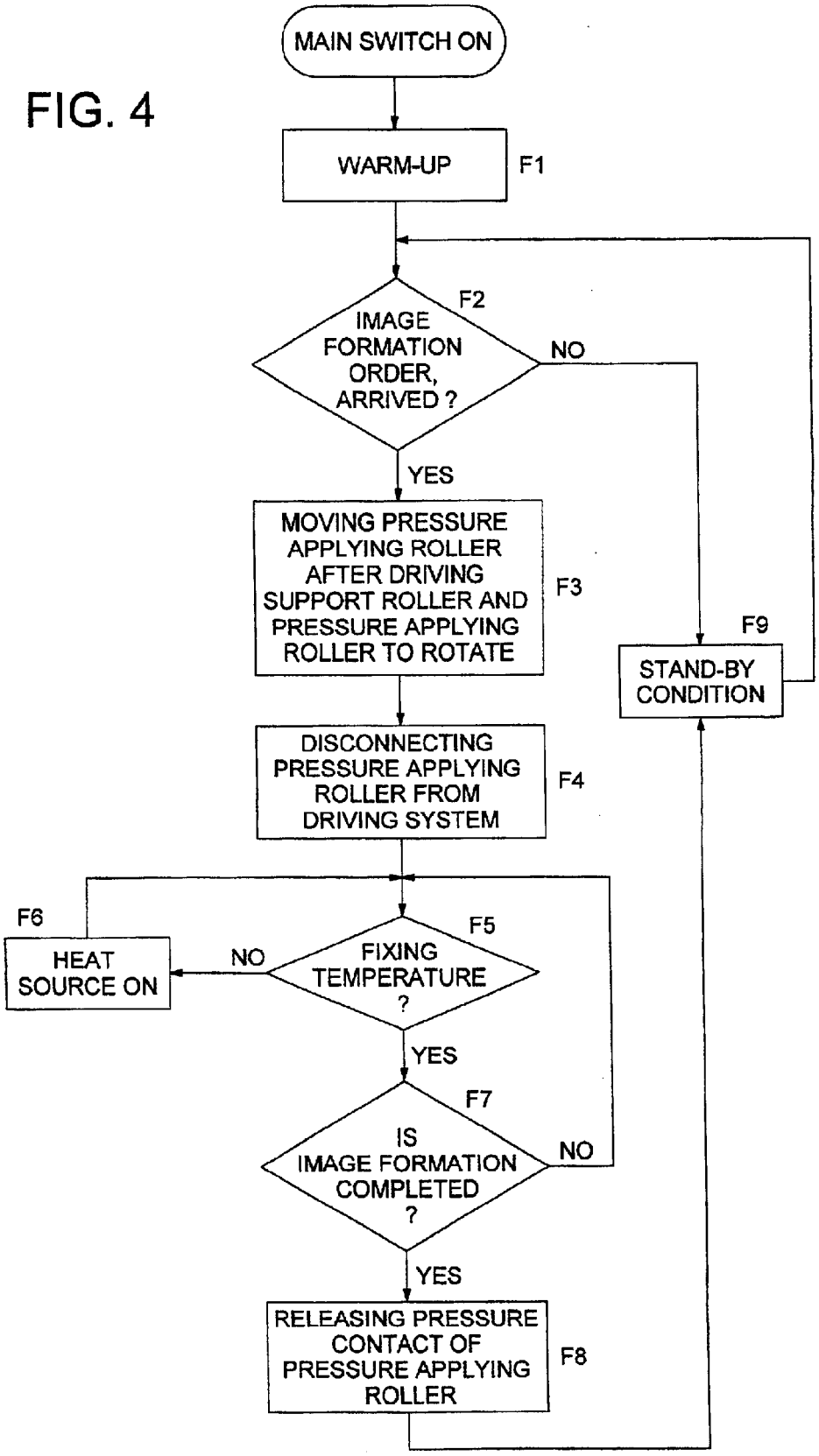
FIG. 4 is a flow chart of the control which is performed by the control means.

FIG. 3 is a block diagram of the control system of the present embodiment, and FIG. 4 is a flow chart of the control which is performed by the control means CPU.

When the main switch of the image forming apparatus is turned on, the electric power is supplied to the heat source H of the fixing device 30 to start the warm-up (F1). When detecting temperature of the temperature sensor SE reaches the prescribed value, the warm-up is finished and the system enters the stand-by condition for waiting the image forming order (F9). When the image forming order (YES of F2) comes, the motors M1 and M2 are started driving so that the support roller 310 and the pressure applying roller 340 are driven to rotate, and the pressure applying roller 340 is changed the position to come into pressure contact (F3). Incidentally, in this example, the motor M1 that is the common driving source drives the support roller 310 and the pressure applying roller 340. In the pressure contact process, the clutch CL is turned off to disengage the pressure applying roller 340 from the driving system, immediately before the pressure applying roller 340 touches the heating belt 300 (F4).

The temperature sensor SE monitors whether temperature of the heating belt 300 reaches the fixing temperature or not, and if it does not reach, the heat source H is turned on (F6). When the image formation is finished (F7), the pressure contact of the pressure applying roller 340 shown in FIG. 2(*a*) is released (F8), and the system enters the standby condition F9. Further, even when there is no image formation order after the end of the warm-up, the system also enters the stand-by condition F9. In the stand-by condition F9, the heat source H is turned off, or electric power of the lower level is supplied to the heat source H, as mentioned above.

In the above-mentioned description, pressure contact pressure contact releasing is performed by moving the pressure applying roller 340, however, it is also possible to use the construction to move the heating belt 300 representing the heating member to perform the pressure contact/pressure contact releasing. Still further, it is possible to use the heating roller in place of the heating belt as the heating member.

In FIGS. 2(*c*) and 2(*d*), when the heating roller 300 has been brought into pressure contact with the pressure applying roller 340, the position of the pressure applying roller 340 is higher than the position shown in FIG. 2(*b*), and due to this, the moving distance between the pressure contact position and the pressure contact released position is greater than the distance between the position shown in FIG. 2(*a*) and the position shown in FIG. 2(*b*). Due to the construction that the tracks of belt conveyance is different between the pressure contact condition and the pressure contact released condition, the moving distance for the pressure applying roller to move for the release of the pressure contact becomes greater than that of the distance shown in FIGS. 2(*a*) and 2(*b*), which makes application of the invention to be more effective. Further, since the length of the recording material P nipped between the heating belt 300 and the pressure applying roller 340 becomes longer, a heating time becomes longer to improve the fixing efficiency.

Incidentally, when back-up member 390 represented by a pad or a roller is arranged at the position where the pressure applying roller 340 stops going up, as shown in FIG. 2(*d*), the adhesion of the recording material P between the pressure applying roller 340 and the heating belt 300 becomes better to improve the fixing efficiency further.

Incidentally, in FIGS. 2(*a*)–2(*d*), an unillustrated pulling mechanism supports the heating roller 320 to give the tension to the heating belt 300.

(The Second Embodiment)

Figure 5:
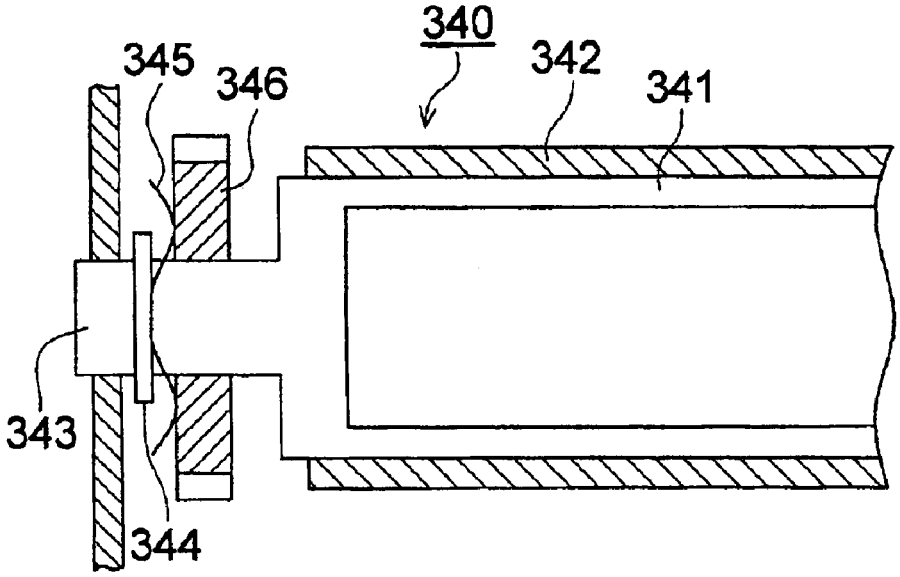
FIG. 5 is a section of the pressure applying roller of the fixing device of a second embodiment of the invention.

FIG. 5 is a section of the pressure applying roller in the fixing device relating to the second embodiment of the present invention, which is showing the other example of the pressure applying roller 340 in the fixing device shown in FIG. 2.

The pressure applying roller 340 in FIG. 5 is composed of base body 341 made of a metal and elastic layer 342, which is the same as the above-mentioned embodiment. The base body 341 has shaft 343, and is rotatably supported on a bracket of the fixing device 30 by the shaft 343. Gear 346 is connected to the motor M1 in FIGS. 2(*a*)–2(*b*), and is rotatably driven by the motor M1. The gear 346 and the shaft 343 are connected each other by slip ring 345 representing a plate spring supported by C-ring 344. That is, though driving power of the gear 346 is transmitted to the shaft 343 via slip ring 345, when more than the prescribed load torque is applied, the construction is that the slip ring slips so that driving power of the gear 346 may not transfer to the pressure applying roller 340.

At the operation start of the fixing device, under the non-load condition that the pressure applying roller 340 is released from the heating belt 300, the pressure applying roller 340 is driven by the motor 1, and rotates at the circumferential speed nearly the same as the speed of the heating belt 300. Then, when the pressure applying roller 340 touches the heating belt 300, the stress caused between the pressure applying roller 340 and the heating roller 300 is absorbed by the action of the slip ring 345 serving as the torque limiter. As a result, the heating belt 300 and the pressure applying roller 340 enter the state of connect without having the stress mentioned above. Accordingly, the above-mentioned deformation or tear caused by the stress is prevented.

The following range is desirable for the transmission torque Q of the slip ring 345.

$$19.6\times10^{-4}<Q<9.8\times10^{-3}N\cdot m$$

When the transmission torque is smaller than the above-mentioned range, it sometimes occurs that the pressure applying roller 340 does not rotate. Further, when the transmission torque is larger than the above-mentioned range, the stress is sometimes caused, when the pressure applying roller 340 touches the heating roller 300, so that the deformation or the change in quality may occur on the surface of the pressure applying roller 340 or the surface of the heating roller 300.

Figure 6:
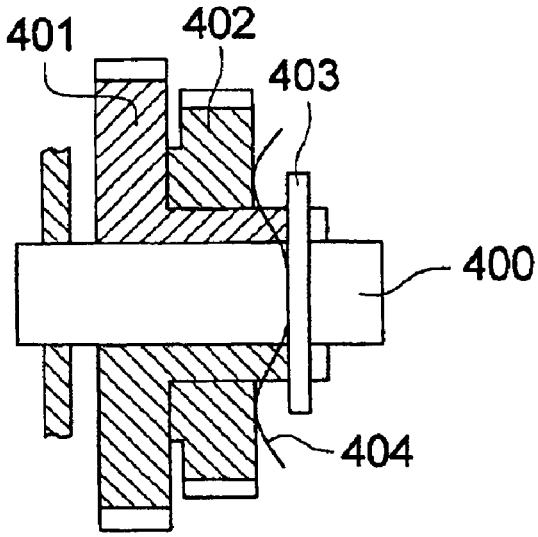
FIG. 6 is a drawing showing an example of a driving mechanism having a torque limiter of the second embodiment of the invention.

FIG. 6 shows the other example of the driving structure having the torque limiter in the second embodiment. A two-step gear shown in FIG. 6 is provided in the drive transfer system from the motor M1 to the pressure applying roller 340. Gear 401 which is supported rotatably on the shaft 400 is connected to the motor M1 shown in FIGS. 2(*a*) and 2(*b*), through an unillustrated driving system. C-ring 403 is mounted on the shaft 400, and the slip ring 404 representing the plate spring is prevented from falling out by the C-ring 403. The slip ring 404 touches the gear 402 connected to the pressure applying roller 340 by an unillustrated driving system. The slip ring 404 works as the torque limiter, and the pressure applying roller 340 is rotatably driven by the motor M1 through the gears 401 and 402, under the non-load condition. That is, under the condition that the pressure applying roller 340 is released from the heating belt 300, the pressure applying roller 340 is rotatably driven by the motor M1, and under the condition that the pressure applying roller 340 touches the heating belt 300, the deformation and the damage of the elastic layers 302 and 342 respectively of the heating belt 300 and pressure applying roller 340 are prevented, because the stress is absorbed by the action of the slip ring 404.

(The Third Embodiment)

The third embodiment is an example wherein the driving power of the driving means for performing the pressure contact/pressure contact releasing of the pressure applying roller is made to be small, and a motor as the driving means that is small in size and has less power consumption can be used.

Figure 7:
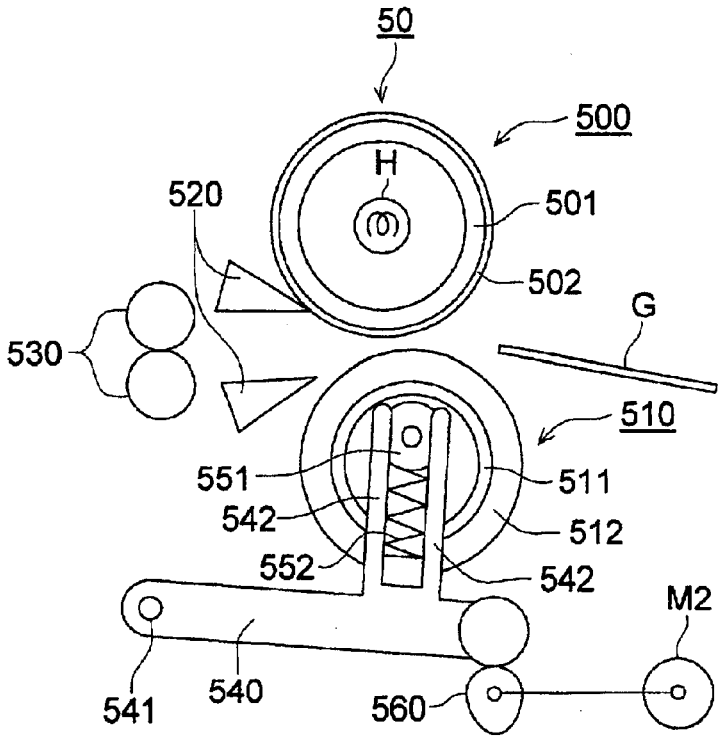
FIGS. 7(*a*) and 7(*b*) are drawings showing constructions of the fixing device of a third embodiment of the invention.
Figure 7:
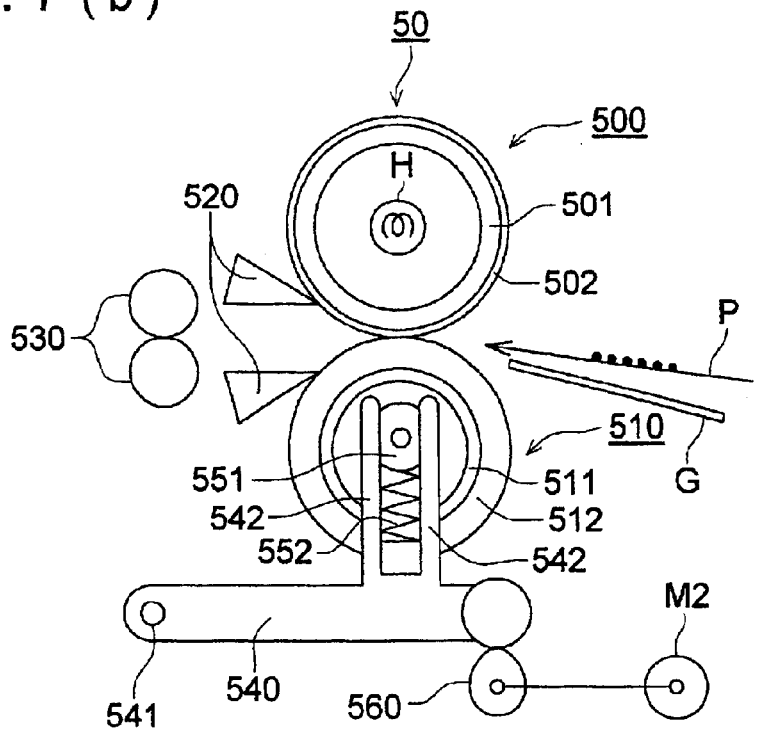

FIGS. 7(*a*) and 7(*b*) show the construction of the fixing device relating to the present embodiment. The fixing device 50 shown in FIGS. 7(*a*) and 7(*b*) can be used as the fixing device 30 in FIG. 1.

In FIGS. 7(*a*) and 7(*b*), symbol 500 is a heating roller, composed of base body 501 made of metal to be cylindrical and of surface layer 502 made of fluororesin to be releasable and heat resistant, and it houses therein heat source H representing a halogen lamp. Numeral 510 is a pressure applying roller, composed of base body 511 made of metal to be cylindrical and elastic layer 512 made of silicon rubber to be heat resistant. Numeral 520 is a separation claw, numeral 530 is a fix-sheet ejecting roller which conveys the fixed recording material P, and symbol G is a guide member which guides an approach of the recording material P.

The pressure applying roller 510 is rotatably supported on supporting member 551. The supporting member 551 is urged upward in FIGS. 7(*a*) and 7(*b*) by coil spring 552 as an urging means. Numeral 540 is a supporting lever rotatably supported on shaft 541, and has two supporting arms 542. The supporting member 551 is supported to be movable up and down between the two arms in FIGS. 7(*a*) and 7(*b*).

FIG. 7(*b*) shows the fixing device 50 being under the working condition, and under the working condition, the pressure applying roller 510 is brought into pressure contact with the heating roller 500 under the prescribed pressure by the coiled spring 552. FIG. 7(*a*) is showing the fixing device 50 under the non-operating condition. The condition shown in FIG. 7(*a*) means that the rotating cam 560 makes the supporting lever 540 to rotate in the direction of reducing the urge of the coiled spring 552. Under the condition shown in FIG. 7(*a*), the pressure applying roller 510 comes to the state of non-urging to leave the heating roller 500. Further, when the fixing device 50 works, the rotating cam 560 drives rotatably the support lever 540 and brings the pressure applying roller 510 into pressure contact with the heating roller 500 as shown in FIG. 7(*b*).

Power for driving action to the support lever 540 by the rotating cam 560 is one which makes the prescribed pressure necessary for the fixing to be the greatest. In the conventional pressure contact/pressure contact releasing mechanism of the pressure roller, the support lever is driven in the direction wherein pressure necessary for the fixing is further increased by urging force by the spring, while the power being stronger than the increasing urging power is necessary for releasing the pressure contact, however in the driving mechanism of the present embodiment, the urging power becomes the greatest under the pressure contacted condition, and it becomes possible to perform the pressure contact/pressure contact releasing of the pressure roller with exceptionally small power than that of the conventional mechanism. By this driving mechanism, a small motor with low power consumption and low cost can be used for the motor M2 as the driving means for the pressure contact/pressure contact releasing.

Figure 8:
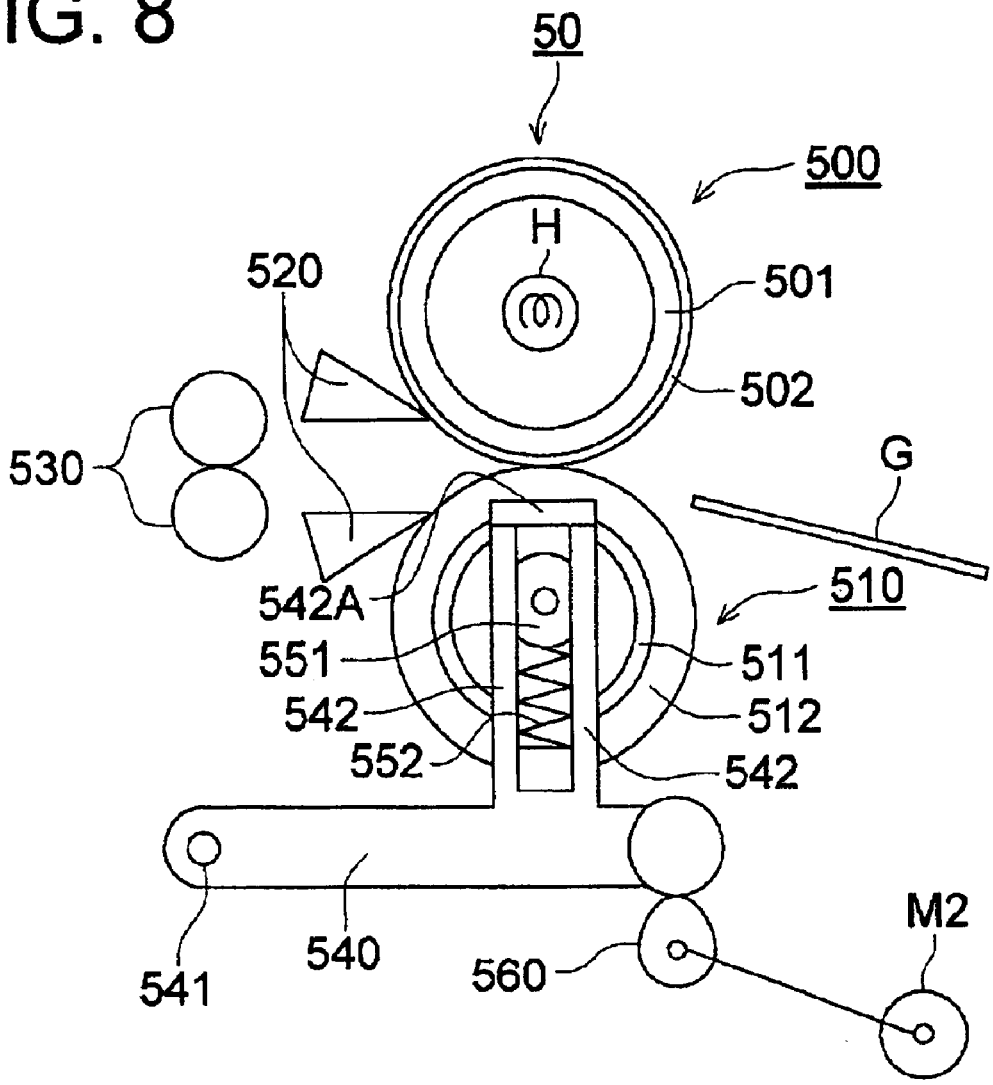
FIG. 8 is a drawing showing the other example of the fixing device of the third embodiment of the invention.

FIG. 8 shows the other example of the fixing device of the third embodiment.

In this example, support arm 542 provided on the support lever 540 has stop section 542A which limits a rise of the supporting member 551 of the pressure applying roller 510. The pressure applying roller 510 is held by the stop section 542A to be away from the heating roller 500 surely, when the fixing device is not operating.

When the pressure applying member separated from the heating member under the stand-by condition is brought into pressure contact with the heating member in the case of image formation, the stress is caused so that the deformation or the change in quality may occur on the heating member or the pressure applying member, however, in Structure 1, 2, 3, 4, 6, 9, 10, 12, 16 or 17, the pressure contact is performed after the pressure applying member or the heating member is brought into the condition of the inertia rotation, thus the above-mentioned stress is prevented, and the deformation or the change of the quality is also prevented.

By Structure 5, 7, 8 or 13, the heat capacity of the heating member can be reduced so that the rise-up time for the heating is shortened, and under the stand-by condition, it is possible to cut off the power supply to the heat source, or it is enough to supply low level power to the heat source, accordingly, it is possible to control the energy consumption effectively for the image forming apparatus.

By Structure 11, it is possible to prevent the stress effectively, in particular, when the pressure applying member is brought into pressure contact with the heating member.

Since the pressure applying roller is made to be away from the heating member by the action in the direction to reduce urging of the urging means for making the pressure applying member to be brought into pressure contact with the heating member by structure 14, 15 or 17, small power is necessary for the pressure contact releasing, and due to this, it is possible to lower the energy consumption for the driving means which performs pressure contact/pressure contact releasing, and further, it is possible to reduce the cost of the driving means.

Structure 16 can make the heating member and the pressure applying member to be away from each other surely under the stand-by condition.

What is claimed is:

1. A fixing device comprising:

a heating member for heating a toner image;

a pressure applying member for contacting with or separating from the heating member;

a changeover device for switching conditions of the heating member and the pressure applying member between a pressure contact condition and a pressure contact released condition; and a driving device for driving the heating member and the pressure applying member under the pressure contact released condition, wherein fixing is conducted by making a recording material carrying thereon the toner image to pass between the heating member and the pressure applying member, under the condition that the pressure applying member is brought into pressure contact with the heating member, and wherein, when the changeover device changes the condition from the pressure contact released condition to the pressure contact condition, the changeover device conducts switching, under the condition that either one of the heating member and the pressure applying member is separated from the driving device and moving by inertia, while the other member is connected to the driving device to move.

2. The fixing device of claim 1, wherein there is provided the driving device for transporting the recording material by driving the heating member.

3. The fixing device of claim 1, wherein the changeover device forms the pressure contact condition and the pressure contact released condition by changing the position of the pressure applying member.

4. The fixing device of claim 1, wherein the changeover device uncouples the pressure applying member from the driving member.

5. The fixing device of claim 1, wherein the heating member is represented by a heating belt, and the fixing is performed by making the heating belt to touch the recording material.

6. The fixing device of claim 5, wherein there is provided the heating device for heating the heating member.

7. The fixing device of claim 6, wherein the heating device has a heat source and a heating roller heated by the heat source, and about which the heating belt is trained.

8. The fixing device of claim 5, wherein the heating belt is provided with a base body and a heat-resistant elastic layer formed on the base body.

9. The fixing device of claim 1, wherein each of the heating member and the pressure applying member is represented by a roller.

10. A fixing device comprising:

a heating member for heating a toner image;

a pressure applying member for contacting with or separating from the heating member; and a driving device for driving the heating member and the pressure applying member under the condition that the pressure applying member is released from the heating member, wherein fixing is conducted by making a recording material carrying thereon the toner image to pass between the heating member and the pressure applying member, under the condition that the pressure applying member is brought into pressure contact with the heating member, and wherein the driving device drives either one of the heating member and the pressure applying member through a torque limiter.

11. The fixing device of claim 10, wherein the torque limiter has transmission torque Q having the range shown by the following formula:

$$19.6\times10^{-4}<Q<9.8\times10^{-3}\ (N\cdot m).$$

12. The fixing device of claim 10, wherein the heating member is represented by a heating roller.

13. The fixing device of claim 10, wherein the heating member is represented by a heating belt.

* * * * *